United States Patent [19]

Diamond et al.

[11] Patent Number: 4,932,563

[45] Date of Patent: Jun. 12, 1990

[54] COMBINED JUG AND SPRAYER

[76] Inventors: Lee G. Diamond; Jeffrey A. Diamond, both of 2525 Innsbrook Rd., Charlotte, N.C. 28211

[21] Appl. No.: 234,509

[22] Filed: Aug. 22, 1988

[51] Int. Cl.[5] ..... B67D 5/56

[52] U.S. Cl. ..... 222/129; 222/143; 222/183; 222/192; 222/383; 239/289; 239/303

[58] Field of Search ..... 222/129, 143, 146.6, 222/183, 192, 383, 131, 130, 175; 220/23.83, 23.86, 23, 20, 466; 239/154, 303, 239

[56] References Cited

U.S. PATENT DOCUMENTS

| | | | |
|---|---|---|---|
| 2,438,906 | 4/1948 | Elsas et al. | 222/129 X |
| 3,154,219 | 10/1964 | Dean et al. | 222/129 |
| 4,030,664 | 6/1977 | Tisbo et al. | 239/289 |
| 4,249,392 | 2/1981 | Hotta | 222/131 X |
| 4,548,339 | 10/1985 | Gorman | 222/129 |
| 4,705,191 | 11/1987 | Itzel et al. | 222/383 X |

FOREIGN PATENT DOCUMENTS

| | | | |
|---|---|---|---|
| 126585 | 2/1901 | Fed. Rep. of Germany | 222/129 |

*Primary Examiner*—Joseph J. Rolla
*Assistant Examiner*—David H. Bollinger
*Attorney, Agent, or Firm*—Daniel E. McConnell

[57] ABSTRACT

This invention relates to an apparatus for containing liquids and for delivering such liquids both by pouring and by spraying. The apparatus has first and second containers defining respective first and second volumes for containing liquid, a closure for the first container which defines a pouring opening for delivery of liquid contained in the first volume, the second container mounted with in the first, and a sprayer operatively communicating with the second volume for delivering liquid therefrom in a spray.

6 Claims, 2 Drawing Sheets

COMBINED JUG AND SPRAYER

FIELD AND BACKGROUND OF INVENTION

This invention relates to an apparatus for containing liquids and for delivering such liquids both by pouring and by spraying.

Individuals who engage in sports activities are familiar with the desirability of having replenishing liquids available for refreshment during such activities as tennis, field sports and the like. Many persons who engage in such sports activities take with them to their play containers of liquids for those purposes, and containers for such purposes are widely known and generally available commercially under such brand names as Gott and Igloo. Typically, the types of liquid containers referred to here will contain a quart, liter or perhaps two such measures of liquids such as water or electrolyte replenishment liquids sold under various brand names such as Gatorade, and will provide for thermal insulation which will keep such contained liquids cool during use in hot weather.

Such apparatus has been found useful by active people, and numbers of such containers have been sold and are in use. However, such apparatus fail to meet a particular need which has been experienced by persons active in hot weather climates.

BRIEF DESCRIPTION OF INVENTION

With the foregoing discussion in mind, it is an object of this invention to provide a container which will contain and deliver liquids for consumption by drinking and also contain and deliver liquids for use in a cooling spray. In realizing this object of the present invention, a user of the apparatus of this invention is enabled to have access to refreshment by drinking liquids and cooling by spraying liquids over their face or head.

A further object of this invention is to provide, in a single container, the possibility of delivering two separate liquids for consumption by drinking and spraying. In realizing this object of the present invention, a first container having a first predetermined volume is used to contain one liquid, while a second, smaller container is housed within the first container and used for containing a second liquid to be dispensed in the alternate way. Preferably, the two volume differ in a proportion related to the relative use of the two liquids.

BRIEF DESCRIPTION OF DRAWINGS

Some of the objects of the invention having been stated, other objects will appear as the description proceeds, when taken in connection with the accompanying drawings, in which.

FIG. I is a perspective view of an apparatus in accordance with this invention.

DETAILED DESCRIPTION OF INVENTION

Figure 1:
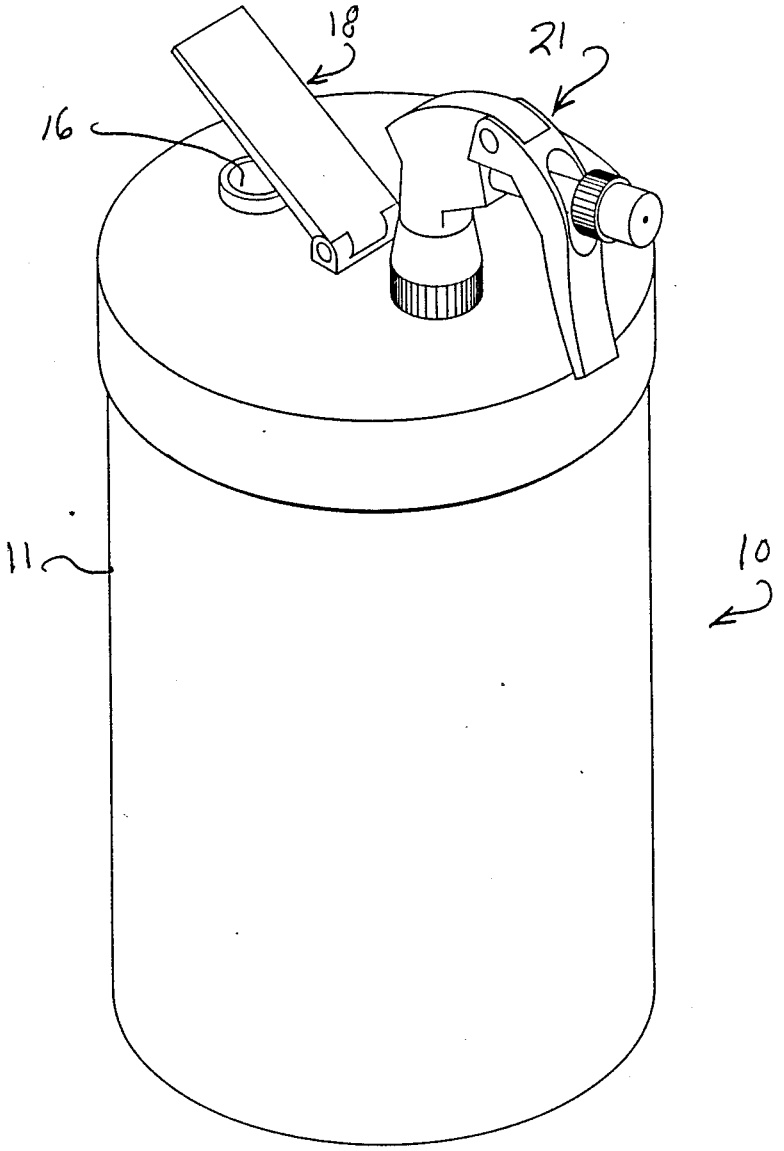
Figure 2:
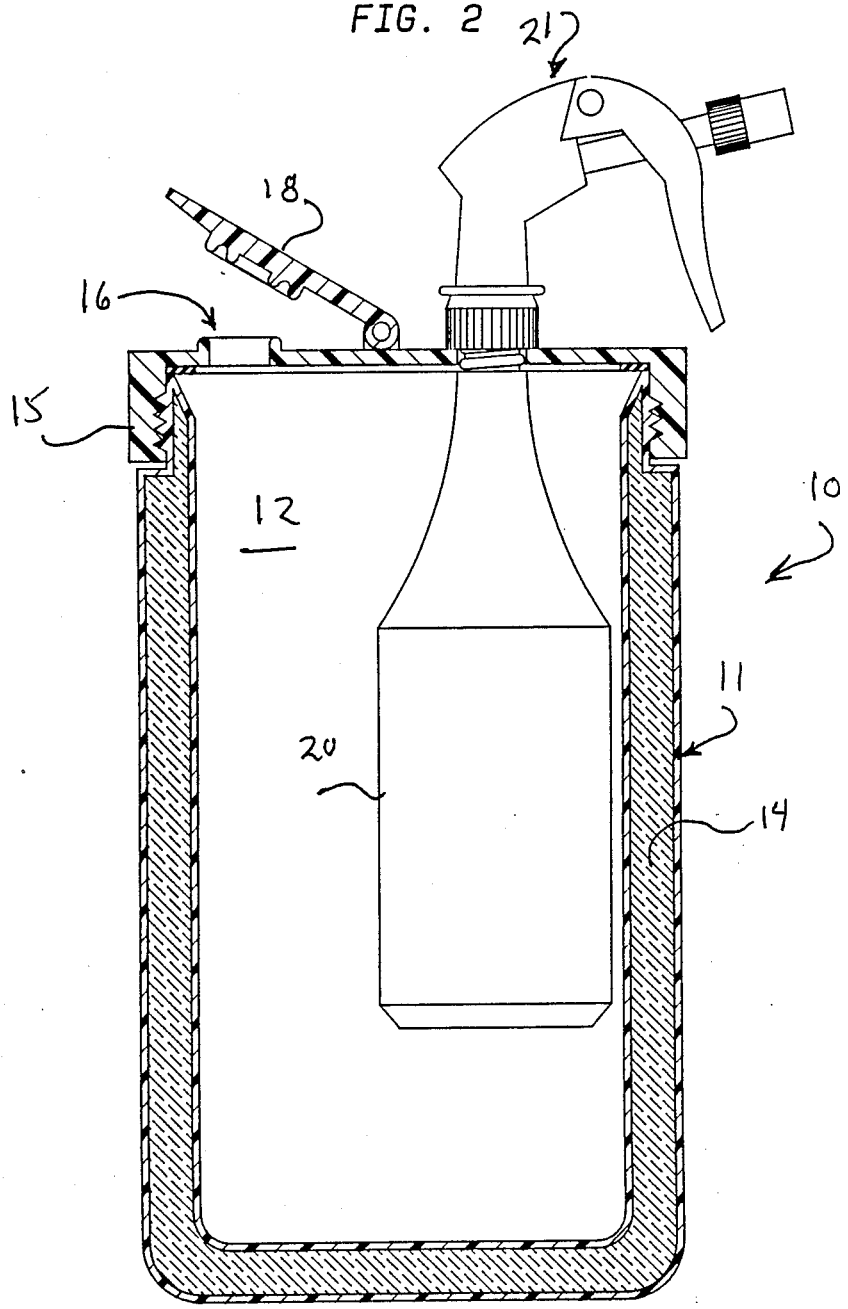
FIG. 2 is an elevation view, partially in section, of the apparatus of FIG. 1.

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the accompanying Figures, the combined jug and sprayer of the present invention is there shown and generally identified at 10. The apparatus comprises a first container 11 defining a first volume indicated at 12 for containing liquid. The first volume 12, in a manner typical of the commercially available products identified above, preferably has thermal insulation means generally indicated at 14 for maintaining liquid held in the first volume at a desired temperature. The first container 11 may be formed, for example, by a double walled, blow molded plastic jug having foam insulation material 14 disposed between the walls.

The first container 11 has a large, open mouth through which liquid may be put into the first volume 12. First closure means 15 are provided for the first container and define a pouring opening 16 for delivery of liquid contained in the first volume for drinking, as by pouring into a drinking container such as a glass or directly into the mouth of a user. A second closure means 18 is provided for closing the pouring opening during normal transportation and handling of the jug.

In accordance with important, distinguishing characteristics of this invention, second container means 20 are provided for defining a second volume which is smaller than said first volume and for containing liquid. In the form illustrated, the second container means 20 takes the form of a single wall bottle or the like sized to fit within the first volume 12. Means, described more fully hereinafter, are provided for mounting the second container 20 from the first closure 15 and disposed within the first volume 12. Sprayer means indicated at 21 are provided and operatively communicate with the second volume within the second container 20 for delivering liquid therefrom in a spray.

Preferably, the sprayer 21 comprises a manually actuated aspirating sprayer for delivering a mist of liquid from the second volume within the second container 20. The second container, in the form illustrated, has a threaded neck portion defining a filling opening and penetrating the first closure 15 so as to be exposed therethrough. The sprayer 21 is secured to and closes the filling opening of the second container 20. With the second container being a single wall bottle or the like, liquid contained within the second container will be maintained at the same temperature as liquid contained within the first volume 12, which may be desirable where the liquid kept for drinking is chilled. Preferably, the relative volumes of the first and second containers is related to the anticipated rate of usage of poured and sprayed liquids, and suitably may be such that the size of the first volume is at least about three times the volume of the second volume.

In the drawings and specifications there has been set forth a preferred embodiment of the invention and, although specific terms are used, the description thus given uses terminology in a generic and descriptive sense only and not for purposes of limitation.

What is claimed is:

1. A combined sprayer and jug comprising:

first container means defining a first volume for containing liquid, closure means for said first container means having a pouring opening defined in said closure means for delivery of liquid contained in said first volume, second container means defining a second volume which is smaller than said first volume and for containing liquid, means mounting said second container means from said closure means and disposed within said first volume, and sprayer means operatively communicating with said second volume for delivering liquid therefrom in a spray, said sprayer means comprising a manually actuated aspirating sprayer for delivering a mist of liquid from said second volume.

2. Apparatus according to claim 1 further comprising means for thermally insulating said first volume and thereby maintaining liquid held in said first volume at a desired temperature.

3. Apparatus according to claim 1 wherein said second container means has an opening exposed through said closure means and further wherein said sprayer means is secured to and closes said opening.

4. Apparatus according to claim 1 wherein said first volume is at least about three times the volume of said second volume.

5. A combined sprayer and jug comprising:

first container means defining a first volume for containing liquid, thermal insulation means for thermally insulating said first volume, first closure means for closing said first container means and having a pouring opening defined in said first closure means for delivery of liquid contained in said first volume, second closure means mounted on said first closure means for closing said pouring opening, second container means defining a second volume for containing liquid which is less than one half the volume of said first container means, means for mounting said second container means from said first closure means and disposed within said first volume, and manually operable sprayer means operatively communicating with said second volume for delivering liquid therefrom in an aspirated mist.

6. Apparatus according to claim 5 wherein said second container has a threaded neck portion penetrating said first closure means and further wherein said means for mounting said second container means comprises a threaded cap for engaging said neck portion and for mounting said sprayer means.

* * * * *